United States Patent [19]

Hatanaka et al.

[11] Patent Number: 5,059,768

[45] Date of Patent: Oct. 22, 1991

[54] CERAMIC HEATER TYPE GLOW PLUG

[75] Inventors: Koji Hatanaka; Takashi Aota, both of Higashimatsuyama, Japan

[73] Assignees: Jidosha Kiki Co., Ltd.; Hitachi Metals, Ltd., both of Tokyo, Japan

[21] Appl. No.: 579,805

[22] Filed: Sep. 10, 1990

[30] Foreign Application Priority Data

Sep. 11, 1989 [JP] Japan ..... 1-232742
May 21, 1990 [JP] Japan ..... 2-129012

[51] Int. Cl.[5] ..... H05B 3/00; F23Q 7/22; F02P 19/00

[52] U.S. Cl. ..... 219/270; 123/145 A; 219/541; 219/544; 219/553; 361/266

[58] Field of Search ..... 219/260–270, 219/544, 552, 553, 541; 123/145 R, 145 A; 361/264–266

[56] References Cited

U.S. PATENT DOCUMENTS 2,914,751 4/1960 Masaka et al. ..... 219/270
4,650,963 3/1987 Yokoi ..... 219/270
4,725,711 2/1988 Minegishi et al. .
4,806,734 2/1989 Masaka et al. .
4,914,274 4/1990 Hatanaka et al. ..... 219/270

FOREIGN PATENT DOCUMENTS 60-86325 5/1985 Japan ..... 219/270
60-103229 6/1985 Japan ..... 219/270
61-93313 5/1986 Japan .
62-186127 8/1987 Japan ..... 219/270
63-83520 4/1988 Japan ..... 219/270

*Primary Examiner*—Anthony Bartis
*Attorney, Agent, or Firm*—Blakely, Sokoloff, Taylor & Zafman

[57] ABSTRACT

A ceramic heater type glow plug includes a U-shaped ceramic heater consisting of a resistive ceramic material, a hollow metal holder, an external connecting terminal, a power control resistor, and a connecting unit. The hollow metal holder has a distal end portion for supporting the ceramic heater via insulating members. The external connecting terminal is insulatingly supported at a rear end of the metal holder. The power control resistor is arranged between one of terminal caps at a rear end side of the ceramic heater housed in the metal holder and the external connecting terminal and performs power supply control with respect to the ceramic heater. The connecting unit connects another one of the terminal caps at the rear end side of the ceramic heater to the metal holder. The power control resistor consists of a metal material having a larger positive resistance temperature coefficient than that of the resistive ceramic material constituting the ceramic heater. The connecting unit includes a hollow metal sleeve for insulatingly housing the power control resistor. The rear end of the metal sleeve is caulked to the rear end of the metal holder while the external connecting terminal is fitted in the metal sleeve via an insulating member.

5 Claims, 3 Drawing Sheets

CERAMIC HEATER TYPE GLOW PLUG

BACKGROUND OF THE INVENTION

The present invention relates to a glow plug having a ceramic heater consisting of a resistive ceramic material and, more particularly, to a self-temperature-controlling ceramic heater type glow plug which can function as a high-speed heating type glow plug and improves heating characteristics to ensure sufficient durability and a long after glow time.

As a glow plug of this type, glow plugs having various types of structures have been conventionally known. Of these glow plugs, a ceramic heater type glow plug has attracted attention since it can function as a high-speed heating type glow plug. For example, as a ceramic heater type glow plug of this type, Japanese Patent Laid-Open No. 57-41523 discloses a glow plug using a ceramic heater in which a heating wire consisting of tungsten (W) or a rhenium (Re) alloy is embedded in an insulating ceramic material. This glow plug has a higher heat transmission efficiency than that of a conventionally used sheath type glow plug and can function as a high-speed heating type glow plug since its heating characteristics or temperature rise characteristics are improved. In the above ceramic heater, however, a speed of heating, i.e., a rate of increasing a temperature is limited due to a difference between linear expansion coefficients of the metal wire and the ceramic material. Therefore, this glow plug still has a problem to function as a high-speed heating type glow plug. This problem as a high-speed heating glow plug cannot be avoided since a material having a large positive resistance temperature coefficient such as tungsten is used as the heating wire.

As a ceramic heater described above, Japanese Utility Model Laid-Open No 62-148869 proposes a ceramic heater manufactured by integrally forming the entire body from the interior to the surface of the heater by a resistive ceramic material. According to such a ceramic heater, the heater itself consisting of the resistive ceramic material is powered to generate heat. Therefore, unlike the ceramic heater in which the metal heating wire or the like is embedded in the insulating ceramic material, this ceramic heater is excellent in durability and can function as a high-speed heating type since its heating characteristics are improved. SiAlON is known as the resistive ceramic material for use in the ceramic heater of this type because SiAlON having a specific resistance which largely varies when the content of titanium nitride as a resistivity imparting material is increased/decreased can be arbitrarily, selectively used as a resistive or insulating material.

In order to allow, however, a conventional glow plug using the ceramic heater consisting of the above resistive ceramic material to rapidly generate a heat so as to function as a high-speed heating type glow plug such that, for example, a temperature of about 800° C. is obtained in about one second, a control means must be provided in a power supply circuit between the glow plug and a battery to flow a large current to improve temperature rise characteristics in an initial stage of power supply, thereby heating the glow plug up to a predetermined temperature, and to prevent an overheating state to obtain saturation at a predetermined temperature (e.g., 1,100° C.). As a result, a circuit arrangement is complicated to increase the manufacturing cost.

In addition, if a battery voltage is directly applied to increase a temperature to a saturation temperature (e.g., 1,100° C.), it takes about five seconds to obtain a heating temperature of, e.g., about 800° C., thereby largely impairing the performance as a high-speed heating type glow plug. Therefore, a demand has arisen for a certain countermeasure against these problems.

Furthermore, in recent years, a strong demand has arisen for the glow plug of this type to adopt a so-called after glow system in which a power supply state is maintained with respect to a glow plug for a predetermined time period after start of an engine to smoothly and correctly perform combustion in the engine. In addition, the after glow time is required to be prolonged as long as possible. That is, control is sometimes performed in a glow plug so as to obtain sharp temperature rise characteristics, to obtain a predetermined saturation temperature (about 1,100° C.) in about, e.g., ten seconds, and to reduce the saturation temperature to a predetermined temperature or less (e.g., 1,000° C. or less), thereby performing power supply after start of an engine, i.e., so-called after glow. That is, in a cold district or the like, even after an engine is started, it takes a long time period to set the engine in a warmup. In addition, in this non-warmup state, noise is large during idling, or white smoke is produced or an engine is stopped due to incomplete combustion, thereby posing an exhaustion of white smoke or noise problem. The after glow system is required to prevent these problems. In order to perform power supply control during after glow, the ceramic heater consisting of the above resistive ceramic material is excellent in durability or the like to achieve its effect. In this case, however, the following problem arises.

That is, as the after glow time as described above, a long time period of, e.g., ten minutes or more is currently required. For this purpose, however, a complicated circuit arrangement capable of properly performing power supply control with respect to the ceramic heater must be provided in a power supply circuit connected to the glow plug, resulting in high manufacturing cost. Therefore, in a ceramic heater type glow plug of this type, a demand has arisen for a certain countermeasure which can solve all the above problems and can properly and reliably realize the function as a high-speed heating type glow plug and so-called overshoot characteristics or the like during after glow.

SUMMARY OF THE INVENTION

It is an object of the present invention to provide a ceramic heater type glow plug which can properly perform power supply control to a ceramic heater and can improve assembly workability.

In order to achieve the above object of the present invention, there is provided a ceramic heater type glow plug including a U-shaped ceramic heater consisting of a resistive ceramic material, a hollow metal holder, an external terminal, a power control resistor, and a connecting unit. The hollow metal holder has a distal end portion for supporting the ceramic heater through insulating members. The external connecting terminal is supported through insulating material at a rear end of the metal holder. The power control resister is a range between one of the terminal caps at rear end side of the ceramic heater housed in the metal holder and the external connecting terminal. The power control resister controls power supply with respect to the ceramic heater. The power control resister consists of a metal material having a larger positive resistance temperature coefficient than that of the resistive ceramic material forming the ceramic heater. The connecting unit connects another one of the terminal caps at the rear end side of the ceramic heater to the metal holder. The connecting unit includes a hollow metal sleeve for insulatingly housing the power control resister. The rear end of the metal sleeve is caulked to the rear end of the metal holder while the external connecting terminal is fitted in the metal sleeve through an insulating member.

According to the present invention, a high power is supplied to the ceramic heater in an initial stage of power supply to cause the heater to rapidly generate heat to achieve performance as a high-speed heating type glow plug. After a predetermined time elapses, power supply to the ceramic heater is performed by a power control resistor to obtain proper saturation temperature and overshoot characteristics which allow after glow over a long time period. In addition, since the power control resistor is arranged inside a holder, an arrangement of the power supply circuit need not be complicated unlike in a conventional structure.

DETAILED DESCRIPTION OF THE PREFERRED EMBODIMENTS

The present invention will be described in detail below by using embodiments shown in the accompanying drawings.

Figure 1:
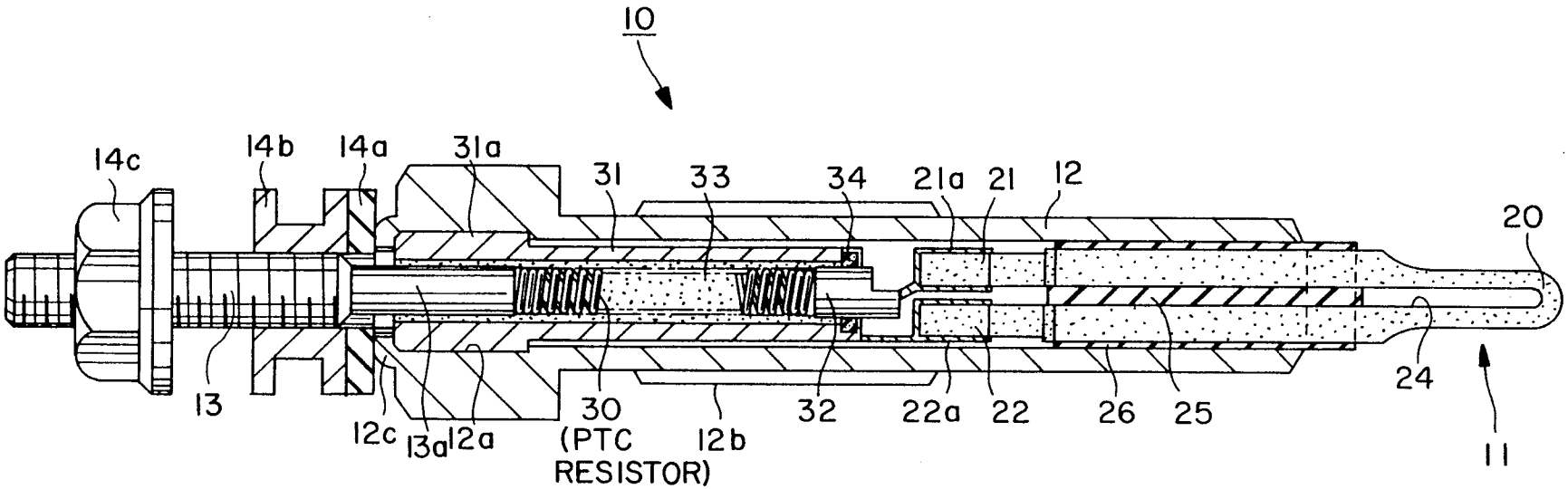
FIG. 1 is a longitudinal side sectional view showing an embodiment of a ceramic heater glow plug according to the present invention.

FIG. 1 shows an embodiment of a ceramic heater type glow plug according to the present invention. A schematic arrangement of a glow plug generally represented by reference numeral 10 will be briefly described below. This glow plug 10 comprises a substantially U-shaped ceramic heater 11 consisting of resistive SiAlON as a resistive ceramic material having a distal end portion which functions as a heating portion, and a substantially tubular metal holder 12 having a distal end portion for holding the heater 11. A power control metal resistor 30 (to be described later) and a large-diameter cylindrical portion 31*a* of a metal sleeve 31 for insulatingly holding an external connecting terminal 13 to be connected in series with the metal resistor 30 are concentrically fitted in and held by a large-diameter hole 12*a* formed at the rear end side of the holder 12. The external connecting terminal 13 is connected to one lead portion (anode side electrode extraction portion) at the rear end side of the ceramic heater 11 via a metal conductor 32 connected to the distal end of the resistor 30 in the sleeve 31. Reference numerals 14*a*, 14*b*, and 14*c* denote an insulating ring, a fixing nut, and an external lead tightening nut, respectively, all of which are threadably engaged with a threaded portion at the rear end side of the external connecting terminal 13. The nuts 14*b* and 14*c* sandwich a lead wire or the like from a battery power source (not shown), thereby electrically connecting the external connecting terminal 13 to a battery terminal. In addition, a threaded portion 12*b* formed on the outer surface of the holder 12 is threadably engaged with a screw hole formed at the engine cylinder head side (not shown) so that the distal end of the heater 11 projects into a subcombustion chamber (combustion chamber).

As the U-shaped ceramic heater 11 described above, a bipolar ceramic heater having a U-shaped heating portion 20, from two ends of which a pair of parallel lead portions 21 and 22 extend backward, and consisting of resistive SiAlON or the like as a whole is used. Terminal caps 21*a* and 22*a* serving as anode- and ground-side electrode extraction portions are brazed to the rear end sides of the lead portions 21 and 22. An elastic connecting piece projecting backward from the ground-side terminal cap 22*a* is connected to the inner end side of the metal sleeve 31 and electrically grounded to the holder 12 via the large-diameter cylindrical portion 31*a* at the sleeve rear end side. In this arrangement, the U-shaped heating portion 20 is formed to have a thickness smaller than that of the lead portions 21 and 22 to reduce its sectional area, thereby obtaining rapid heating characteristics and properly controlling its saturation temperature to enable after glow over a long time period. In FIG. 1, reference numeral 24 denotes a slit formed in the longitudinal direction at the center of the heater 11 from a portion of the U-shaped heating portion 20 formed to have a small diameter at the distal end of the heater 11 to a portion between the lead portions 21 and 22. An insulating sheet 25 consisting of an insulating ceramic material is inserted in at least a portion in the slit 24 between the rear end sides of the lead portions 21 and 22 and corresponding to the distal end portion of the holder 12 and integrally connected to the lead portions 21 and 22 consisting of the resistive ceramic material, thereby closing the slit 24 at the distal end portion of the holder 12 to seal a combustion pressure or a combustion heat inside the holder 12. An insulating coating layer 26 consisting of insulating glass or the like is formed on the outer surface (the outer surfaces of the lead portions 21 and 22 and the insulating layer 26) at substantially the central portion in the longitudinal direction of the heater 11. A metallizing layer is provided on the surface of the insulating coating layer 26, and the heater 11 is fixed by silver brazing or the like to the distal end portion of the holder 12 via the metallizing layer Referring to FIG. 1, reference numeral 12*c* denotes a caulking portion formed at the rear end portion opening edge of the holder 12 to fit and caulk the large-diameter portion 31*a* at the rear end side of the sleeve 31 into the large-diameter hole 12*a* of the holder 12. The above-mentioned elastic connection member projecting backward from the anode-side terminal cap 21*a* is connected to the metal conductor 32 side insulatingly held at the inner end of the sleeve 21.

According to the present invention, in the glow plug 10 having the above arrangement, the terminal cap portion (anode-side terminal cap portion 21*a*) at the rear end side of the ceramic heater 11 and the inner end of the external connecting terminal 13 head at the rear end portion of the holder 12 are connected in series with each other via the power control resistor 30 consisting of a metal material (e.g., iron or nickel) having a larger positive resistance temperature coefficient than that of the resistive SiAlON (resistive ceramic material) which forms the heater 11. In this embodiment, a coil-like member is used as the resistor 30 and inserted into the metal sleeve 31 while two ends of the coil-like member are connected to the external connecting terminal 13 and the metal conductor 32 by spot welding In addition, a heat-resistant insulating powder 33 such as magnesia (MgO) or zirconia ($ZrO_2$) is filled into the metal sleeve 31, and fluctuation/vibration is applied or swaging is performed so that the heat-resistant insulating powder 33 is filled at a high density. Referring to FIG. 1, reference numeral 34 denotes an O-ring for sealing one end of the metal sleeve 31 having two open ends when the resistor 30 or the like is inserted in the metal sleeve 31 and the heat-resistant insulating powder 33 is filled therein. The large-diameter portion 31*a* of the metal sleeve 31 as a unit integrally incorporating these members is fitted in the large-diameter hole 12*a* at the rear end side of the holder 12 and fixed by the caulking portion 12*c*. In this case, the heat-resistant insulating powder 33 is filled between the metal sleeve 31 and the distal end 13*a* of the external connecting terminal 13 to keep the two members insulated from each other. The anode-side terminal cap 21*a* at the rear end side of the heater 11 is connected to the external connecting terminal 13 via the metal conductor 32 insulatingly held in the sleeve 31 and the resistor 30, and the ground-side terminal cap 22*a* is connected to the sleeve 31 so as to be grounded at the holder 12 side.

With the above arrangement, high power can be supplied to the ceramic heater 11 in an initial stage of power supply to cause the heater 11 to rapidly generate heat, thereby achieving the performance as a high-speed heating type glow plug. In addition, after a predetermined time elapses, power supply to the ceramic heater 11 is performed by the power control resistor 30 to obtain proper saturation temperature and overshoot characteristics which allow after glow over a long time period. Since the power control resistor 30 is arranged inside the holder 12, an arrangement of the power supply circuit need not be complicated unlike in a conventional structure. In the structure of the above embodiment, the resistor 30 is sealed at a high density in the sleeve 31 via the heat-resistant insulating powder 33. Therefore, a heat radiation property and the like depending on, e.g., a heat conductance, are stabilized, and a high heat resistance is obtained, thereby realizing a desired power control function.

Figure 2:
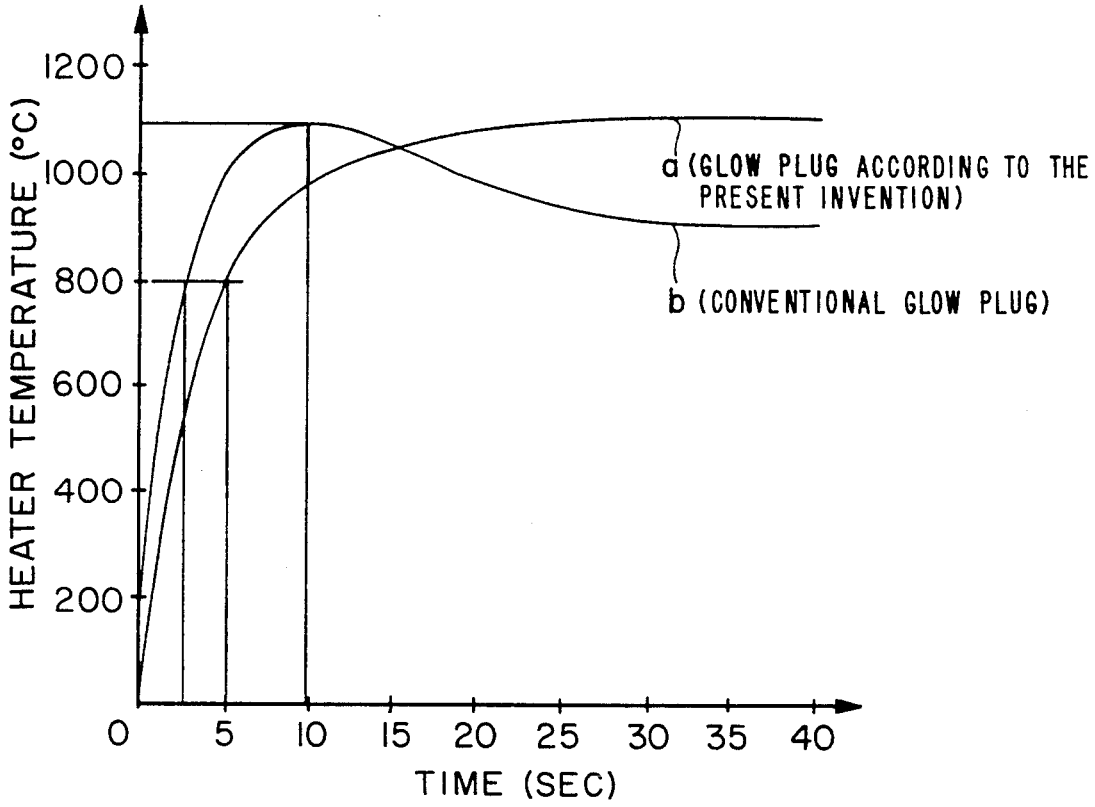
FIG. 2 is a graph for explaining heating characteristics of the glow plug shown in FIG. 1.

When the glow plug 10 is constituted by the ceramic heater 11 having the above arrangement in combination with the power control resistor 30, the glow plug 10 can achieve good heating characteristics as shown in FIG. 2. Referring to FIG. 2, reference symbol a denotes a heating characteristic obtained by the glow plug 10 according to the present invention. As compared with a conventional glow plug having heating characteristics denoted by reference symbol b in FIG. 2, the glow plug 10 can achieve a function as a high-speed heating type glow plug, prevent oversaturation, and obtain predetermined overshoot characteristics to enable after glow over a long time period. These advantages of the glow plug 10 of the present invention will be easily understood.

In addition, in the above arrangement, a lead wire or the like required to connect the ceramic heater 11 to the external connecting terminal 13 or the like in a conventional structure can be omitted, and the ground side is formed by using the sleeve 31, resulting in a simple arrangement and good workability. In addition, proper electrical connection can be obtained.

The material of the resistor 30 preferably has a positive resistance temperature coefficient (PTC) much larger than that of the resistive SiAlON as a resistive ceramic material of the ceramic heater 11. Examples of the material are tungsten (W), nickel (Ni), and iron (Fe).

According to the above glow plug, therefore, since the power control resistor 30 easily incorporated as a unit in the holder 12 controls an application voltage to the ceramic heater 11, the function as a high-speed heating type glow plug and a long after glow time can be achieved without additionally providing a complicated control circuit which is used in a conventional arrangement, resulting in a great advantage. In particular, according to the above arrangement, a time required to obtain a heating temperature of 800° C. can be set to be about two to three seconds, and a saturation temperature of 1,000° C. or less can be realized. In addition, a peak temperature can be kept below 1,100° C. or less to enable after glow over ten minutes or more. This will be easily understood from the graph shown in FIG. 2.

Figure 3:
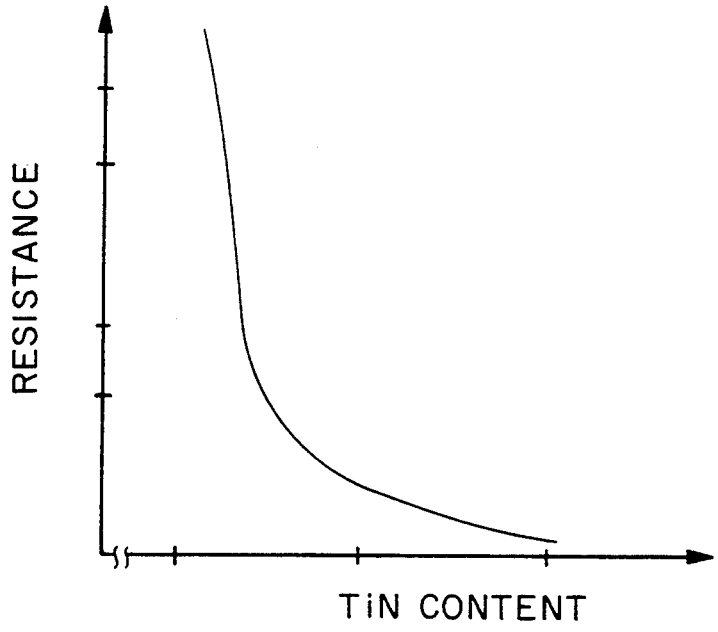
FIG. 3 is a graph showing a relationship between the content of titanium nitride and a resistance for obtaining resistive SiAlON.

According to the glow plug 10 using the above resistor 30, a power supply circuit of the ceramic heater 11 is allowed to achieve the function as a voltage drop control means by the resistance of the resistor 30, thereby reducing the voltage to be applied to the ceramic heater 11 upon power supply. As a result, the content of titanium nitride is increased to eliminate a heating characteristic variation which is a problem in a conventional structure. That is, as is apparent from FIG. 3, in a resistive ceramic material such as resistive SiAlON, the content of titanium nitride as a resistivity imparting material must be determined within a small range in consideration of heating characteristics or variation. If a resistance is determined by using a battery voltage (e.g., 12 V) as a rated voltage and the content of titanium nitride is determined within this range, the content becomes too small to increase a variation in performance. According to the present invention, however, the application voltage is reduced by the presence of the resistor 30 to increase the content of titanium nitride, thereby eliminating a variation in resistance in the manufacture of a glow plug.

In addition, according to the above arrangement, since the metal sleeve 31 is fitted in the large-diameter portion 12*a* at the rear end portion of the holder 12 and fixed by the caulking portion 12*c*, the metal sleeve 31 need not be supported in the metal holder 12. Therefore, the ceramic heater 11 and the metal sleeve 31 need only be sequentially inserted into the metal holder 12, and a product can be completed by fixing the metal sleeve by the caulking portion 12*c* and brazing the ceramic heater coating layer 26 on the holder 12. As a result, assembly of the glow plug can be largely simplified.

Figure 4:
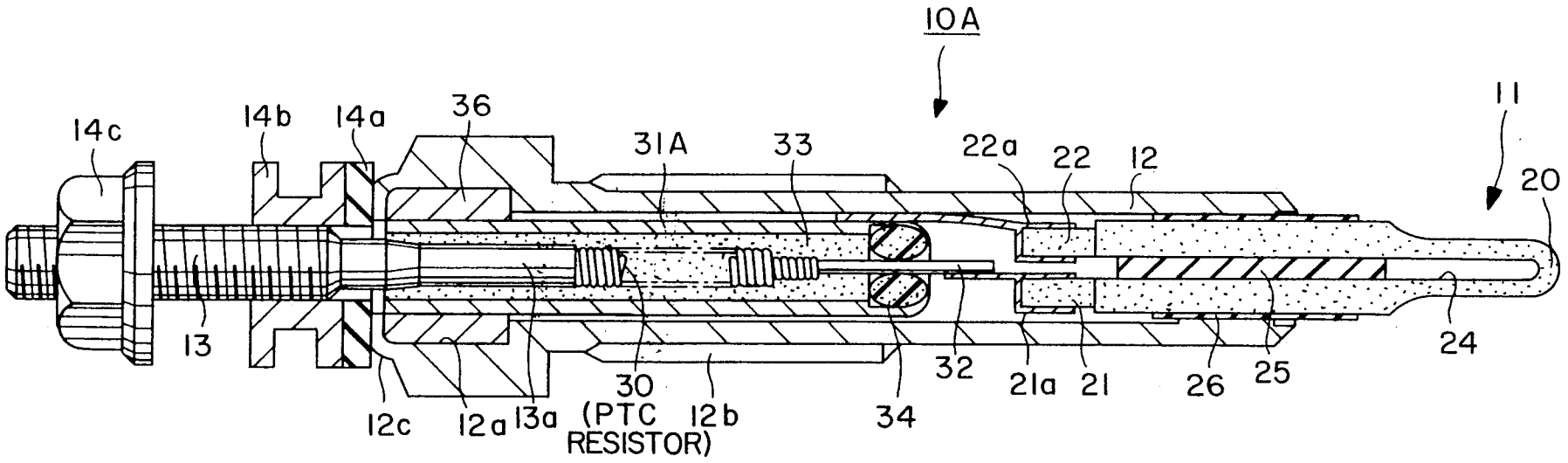
FIG. 4 is a longitudinal side sectional view showing another embodiment of a ceramic heater type glow plug according to the present invention.

FIG. 4 shows another embodiment of the present invention. In this embodiment, in a glow plug 10 having the above arrangement, a straight thin-walled pipe member is used as a metal sleeve 31 for holding a power control resistor 30 having a larger positive resistance temperature coefficient and connected to an anode-side terminal cap 21*a* at the rear end side of a ceramic heater 11 consisting of resistive SiAlON so that the power control resistor 30 is embedded in a heat-resistant insulating powder 33, and a large-diameter thick-walled metal pipe member 36 to be fitted in a large-diameter hole 12*a* formed at the rear end portion of a holder 12 and fixed by a caulking portion 12*c* is integrally fixed to the rear end portion of the metal sleeve 31 by press fit or the like.

That is, in order to embed the power control resistor 30 into the heat-resistant insulating powder 33 and assemble these parts in the metal sleeve 31, the sleeve 31 must be subjected to swaging (diameter reducing processing) to fill the heat-resistant insulating powder 33 at a high density, thereby allowing the resistor 30 to achieve a predetermined function as a resistor. If, however, the large-diameter cylindrical portion 31*a* is present at the rear end portion of the sleeve 31 as in the embodiment shown in FIG. 1 described above, a step is formed on the outer shape of the sleeve 31, resulting in a cumbersome processing due to a two-step structure. In addition, it becomes difficult to obtain a predetermined swaging state in which an internal filling efficiency is increased. Therefore, in order to obtain a desired function of the power control resistor 30, a problem may be posed in workability or manufacturing cost.

For this reason, in this embodiment, the metal sleeve 31 is assembled stepwise to obtain a two-step structure. That is, the resistor 30 and the heat-resistant insulating powder 33 are assembled in the sleeve 31, and the sleeve 31 is subjected to swaging. Thereafter, the above thick-walled pipe member 36 is fixed to the rear end portion of the sleeve 31 by press fit or the like. With this arrangement, therefore, the assembly of the resistor 30 can be very easily incorporated in the sleeve 31 to obtain a predetermined function, resulting in high workability and low cost. In this case, the thick-walled pipe member 36 is fixed to the sleeve 31 by not only press fit but also brazing, caulking of an outer surface, or a combination thereof. That is, the pipe member 36 can be fixed to the sleeve by any means as long as the sleeve 31 is fixed in a predetermined state when the pipe member 36 is fitted in the large-diameter hole 12*a* at the rear end portion of the holder 12. In addition, in this embodiment, a distal end 13*a* of an external connecting terminal 13 is tapered toward the heater 11. Therefore, the heat-resistant insulating powder can be easily filled in the sleeve 31 to ensure insulation between the sleeve 31 and the distal end 13*a*.

Note that the present invention is not limited to the structures of the above embodiments but the shape or structure of each part of the glow plug 10 can be arbitrarily modified and changed. For example, in each of the above embodiments, the glow plug 10 has the ceramic heater 11 formed by using resistive SiAlON as a resistive ceramic material corresponding to the content of titanium nitride. The present invention, however, is not limited to the above structure of the glow plug 10 or the above shape or structure of the ceramic heater 11. In addition, various modifications may be made for the assembly structure of the power control resistor 30.

As has been described above, according to the present invention, the ceramic heater type glow plug includes a ceramic heater consisting of a resistive ceramic material to be held at the distal end portion of a holder, and a terminal cap portion at the rear end side of the heater and the inner end of an external connecting terminal held at the rear end portion of the holder are connected in series with each other via a power control resistor consisting of a metal material having a larger positive resistance temperature coefficient than that of the resistive ceramic material forming the heater. Therefore, regardless of a simple and inexpensive arrangement in which a power supply circuit is not complicated unlike in a conventional arrangement, high power can be supplied to the ceramic heater in an initial period of power supply to cause the heater to rapidly generate heat, thereby achieving performance as a high-speed heating type glow plug. In addition, after a predetermined time elapses, power supply to the ceramic heater is performed by the power control resistor to obtain proper saturation temperature characteristics and overshoot characteristics which enable long-time after glow as a countermeasure against engine exhaustion or noise.

In particular, according to the present invention, a glow plug having high durability and good heating characteristics can be obtained by using a ceramic heater consisting of a resistive ceramic material. In addition, the resistive ceramic material itself can achieve a self-temperature-controlling property by the power control resistor embedded in the holder. Furthermore, the entire preheating device can be simplified and manufactured at low cost.

What is claimed is:

1. A ceramic heater type glow plug comprising:

a U-shaped ceramic heater consisting of a resistive ceramic material, said heater having a front heating end and a rear end having a pair of terminal caps;

a hollow metal holder having a distal end portion housing the rear end of said ceramic heater and supporting said ceramic heater via electrically insulating members;

an external connecting terminal electrically insulatingly supported at a rear end of said metal holder;

a power control resistor, electrically connected between one of said terminal caps at the rear end side of said ceramic heater housed in said metal holder and said external connecting terminal, for performing power supply control with respect to said ceramic heater; and connecting means electrically connecting the other of said terminal caps at the rear end side of said ceramic heater to said metal holder, wherein said power control resistor consists of a metal material having a larger positive resistance temperature coefficient than that of said resistive ceramic material constituting said ceramic heater, said connecting means includes a hollow metal sleeve extending in the direction of said heater spatially separated from said metal holder electrically insulatingly housing said power control resistor, and the rear end of said metal sleeve is caulked to the rear end of said metal holder while said external connecting terminal is fitted in said metal sleeve via an electrically insulating means.

2. A plug according to claim 1, wherein an insulating sheet is arranged in a slit at the rear end of said U-shaped ceramic heater housed in said metal holder to externally seal said metal holder.

3. A plug according to claim 1, wherein said insulating means arranged between said external connecting terminal and said metal sleeve is a heat-resistant insulating powder, said heat-resistant insulating powder being filled around said power control resistor housed in said metal sleeve.

4. A plug according to claim 3, wherein an O-ring for sealing said heat-resistant insulating powder filled in said metal sleeve is arranged at a distal end of said metal sleeve.

5. A plug according to claim 1, wherein the rear end of said metal sleeve has a large-diameter portion, an end of said large-diameter portion closer to said power control resistor being engaged with a step portion formed inside said metal holder to serve as a stopper.

* * * * *